US007283777B2

(12) United States Patent
Russel et al.

(10) Patent No.: US 7,283,777 B2
(45) Date of Patent: Oct. 16, 2007

(54) SYSTEM AND METHOD FOR CHARACTERIZING FUSER STRIPPING PERFORMANCE

(75) Inventors: Steven M. Russel, Pittsford, NY (US); Mansour Messalti, Sherwood, OR (US); Jeremy Christopher deJong, Orchard Park, NY (US); Anthony S. Condello, Webster, NY (US); Daniel James McVeigh, Webster, NY (US); Donald M. Bott, Rochester, NY (US); James Joseph Padula, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 11/343,672

(22) Filed: Jan. 31, 2006

(65) Prior Publication Data

US 2007/0177913 A1 Aug. 2, 2007

(51) Int. Cl.
*G03G 15/20* (2006.01)

(52) U.S. Cl. ..... 399/322; 399/323; 399/324

(58) Field of Classification Search ..... 399/323, 399/33, 315, 21, 324, 322
See application file for complete search history.

(56) References Cited

U.S. PATENT DOCUMENTS

| | | | | |
|---|---|---|---|---|
| 4,952,982 | A * | 8/1990 | Tabuchi | 399/22 |
| 5,282,009 | A * | 1/1994 | Derimiggio | 399/46 |
| 5,406,363 | A * | 4/1995 | Siegel et al. | 399/323 |
| 6,795,677 | B2 | 9/2004 | Berkes et al. | |

* cited by examiner

*Primary Examiner*—David M. Gray
*Assistant Examiner*—Geoffrey T Evans
(74) *Attorney, Agent, or Firm*—Duane C. Basch; Basch & Nickerson LLP

(57) ABSTRACT

Disclosed herein are several embodiments to facilitate the characterization of fuser stripping performance. Recognizing that the characteristics of a substrate exiting a fusing nip are indicative of the operation of the nip and the stripping operation itself, several contact and non-contact sensing methods are described to detect or predict degraded stripping performance, thereby permitting one or more compensation techniques to be employed, or to identify the need for fuser subsystem replacement.

5 Claims, 14 Drawing Sheets

| Frame | Lead Edge X (Distance) | Y (mm) |
|---|---|---|
| I | 20 mm | -4.0 |
| II | 36 mm | -4.3 |
| III | 52 mm | 2.7 |
| IV | 68 mm | 3.8 |
| V | 84 mm | 3.3 |
| VI | 100 mm | 3.0 |

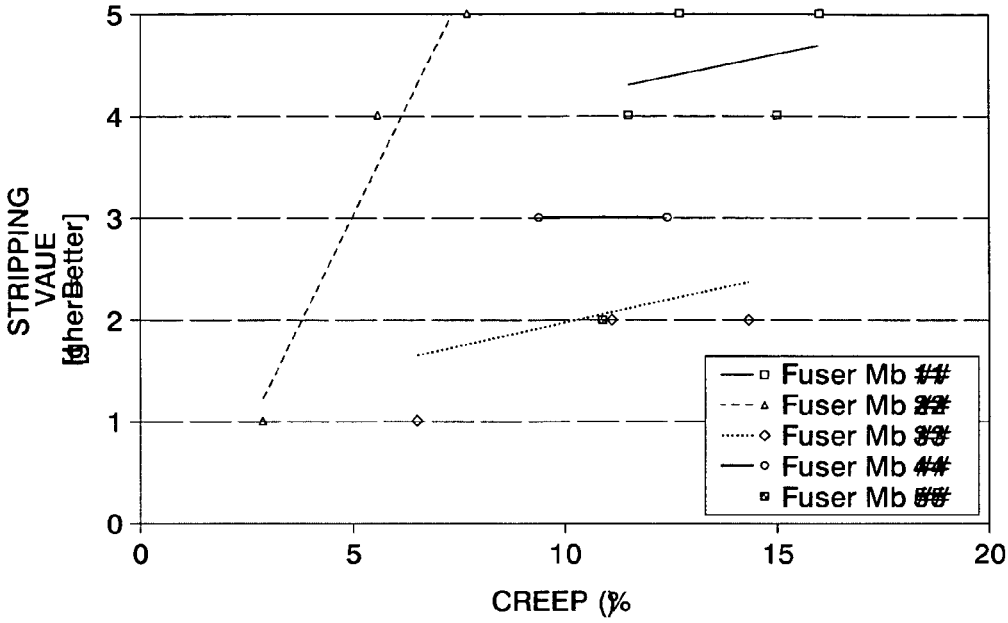
FIG. 11
FIG. 12
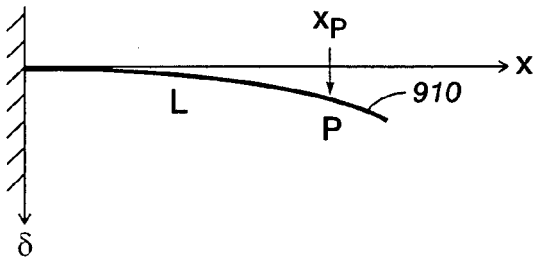

SYSTEM AND METHOD FOR CHARACTERIZING FUSER STRIPPING PERFORMANCE

A system and method are described to improve the characterization of fuser stripping performance, and more particularly one or more alternative sensing methods are employed to detect or predict degraded stripping performance permitting use of a compensation technique to be employed, or to identify the need for fuser subsystem replacement.

BACKGROUND AND SUMMARY

Lightweight paper stripping from a fuser roll is a recurring mode of failure in most fusing subsystems. Instead of the paper exiting the fusing subsystem it remains attached to the fuser roll, and results in a machine/roll failure. Many devices are currently in use to extend fuser roll life and facilitate lightweight paper stripping, including creep-based nip-forming fuser rolls (as described in U.S. Pat. No. 6,795,677 to Berkes et al. for High Speed Heat and Pressure Belt Fuser, hereby incorporated by reference in its entirety), stripping fingers, oiling subsystems and air knives. All of these devices are so called 'dumb' systems, operating in a standalone manner.

U.S. Pat. No. 5,406,363 to Siegel et al. for a "PREDICTIVE FUSER MISSTRIP AVOIDANCE SYSTEM AND METHOD," discloses the use of feed-forward information (e.g., paper weight, image type, humidity, etc.) to predict the likelihood of fuser mis-strips and also claims compensation techniques—for example, increasing oil rate or increasing stripping force (air knife pressure or contact force)—that can be employed to reduce the number of failures.

Fuser stripping failures are significant because, first of all, any stripping failure requires the customer to open the fuser to remove jammed paper. This paper, which can contain un-fused toner, is often wrapped around extremely hot surfaces and pinched between high-pressure nips, making removal difficult. Second, stripping failures can significantly reduce the life of the fuser itself. In a contact-stripping system, high forces produced by a stripping failure often permanently damage the fusing member (e.g.: stripper-finger gouging of roll surface). In non-contact stripping systems mis-strips result in extended contact times between the reactive toner and the reactive fusing surface, often dramatically decreasing the chemical release life of these systems. Avoiding stripping failures requires aggressive stripping devices such as high-pressure air knives or high-load stripping fingers, which may cause other failures. Another alternative solution is to limit the machine to printing non-stressful papers and/or images.

From a strategic perspective, the need to avoid stripping failures places enormous constraints on fuser design and often leads to performance tradeoffs. For example, some production print systems employ fusers that require an undesirable lead-edge bleed (8 mm in size), or limit the usable substrates to only papers with greater than 80 gsm.

One of the solutions proposed herein is to monitor the performance of a fuser in-situ, using any of a number of diagnostic techniques and methods, and then using that information as feedback to warn a customer of impending failure, or to adjust the printed image or paper to avoid stripping failure. Such a solution would likely allow continued operation, albeit possibly with some deterioration in the system operation. A monitoring method and system disclosed herein allows in-line monitoring of stripping forces and post-fuser paper trajectories, leading toward prediction of fuser roll life and warning of imminent stripping failures. A sensor based control system, like that disclosed herein, would be able to monitor stripping performance and engage stripping facilitators in a 'smart' manner.

In xerographic production printing systems, such as the Xerox iGen production printer, fusing architectures often employ sensors that straddle the fusing nip—a paper entrance sensor and paper exit sensor. The known use of such sensors has been for jam detection, but it is presently recognized that such sensors can also be used for other purposes, such as timing of sheet passage through the fuser. For example, when the stripping subsystem is operating optimally, paper takes the shortest path between the two sensors, and thus the shortest time. As stripping performance degrades, however, the paper releases from the fusing roll at angles further and further from the centerline of the nip. This action likely generates paper pathlines that are no longer a straight line, but instead follow curved trajectories from the paper release point until the acquisition by the exit transport. The longer the pathline, the greater the time between the sensors detection of the paper. As described in more detail below, this is one method of monitoring the stripping performance of the system, either to provide early warning of failure, or to adjust a stripping facilitator.

A difficulty also exists in quantitatively predicting stripping performance of a color fuser, either initially or with degradation over the fuser's life, and of stripping life, either by print number or time. Hence, it is not unusual to observe order-of-magnitude differences in chemical release life and stripping life for fusers and their components. Moreover, expectations are low that a purely feed-forward solution can be achieved for most color fusers (albeit acknowledging that B/W systems might be substantially better behaved).

The systems and methods disclosed herein are part of a technique or strategy surrounding the use of in-line stripping sensors downstream of a fuser, combined with potential feedback control of various fuser/imaging parameters. Accordingly, another embodiment is directed to the use of post-fuser exit paper-path components, such as a dedicated finger or existing baffle, outfitted with multiple strain gauges. When used with diagnostic techniques described herein, such an embodiment can unobtrusively measure both the paper stripping forces and the paper exit trajectory, in contact or non-contact stripping systems.

Detecting or sensing characteristics of the paper exit trajectory allows one to monitor fuser roll stripping performance and predict imminent fuser roll failure. The post-fuser paper trajectory is an indicator for stripping performance because, as performance degrades, the paper remains attached to the roll for longer and longer times. As described above, this increases the distance of the paper release point from the centerline of the fusing nip, changing the angle between the paper's lead edge and, typically, horizontal. The change in this angle changes the paper's initial trajectory and ultimate path line. As both stripping force and exit trajectory are demonstrated to be strong predictors of impending stripping failure and fuser roll end-of-life, this embodiment may be used to further improve the monitoring of stripping performance in association with a fuser or similar subsystem in a paper path.

Techniques to resolve all or part of the substrate's pathline further include, but are not limited to: measuring the release point/angle; measuring the lead edge height at various locations; measuring multiple edge heights on a single sheet at a single location; monitoring the proximity of the sheet to an object in the post nip geometry; and measuring the distance from the fusing nip that the paper's lead edge engages the exit baffle/transport.

Disclosed in embodiments herein is a method for monitoring stripping performance in a substrate nip, comprising: detecting at least one characteristic indicative of the separation of a substrate from the nip and generating and representing the at least one characteristic; and adjusting, in response to the signal, at least one of a plurality of parameters related to the substrate nip to alter the at least one characteristic indicative of the separation of the substrate.

Also disclosed in embodiments herein is a method for monitoring stripping performance of a fuser in a xerographic printing machine, comprising: detecting at least one characteristic indicative of the separation of a substrate from the fuser and generating a signal indicative thereof; and adjusting, in response to the signal, at least one of a plurality of parameters related to the fuser to alter the at least one characteristic indicative of the separation of the substrate.

Further disclosed in embodiments herein is a printing system in which a toner image is fused to a substrate sheet in a fuser, comprising: a sensor for monitoring at least one of a plurality of parameters indicating separation of the sheet from the fuser and generating a signal indicative thereof; and a controller, responsive to the signal, for adjusting at least one of a plurality of parameters effecting separation of the sheet from the fuser.

BRIEF DESCRIPTION OF THE DRAWINGS

FIGS. 8-11 are charts of empirical data illustrating the effect of various factors on fuser stripping;

FIG. 12 is an orthogonal diagram depicting a cantilevered stripping finger in accordance with an embodiment disclosed herein;

DETAILED DESCRIPTION

Figure 1A:
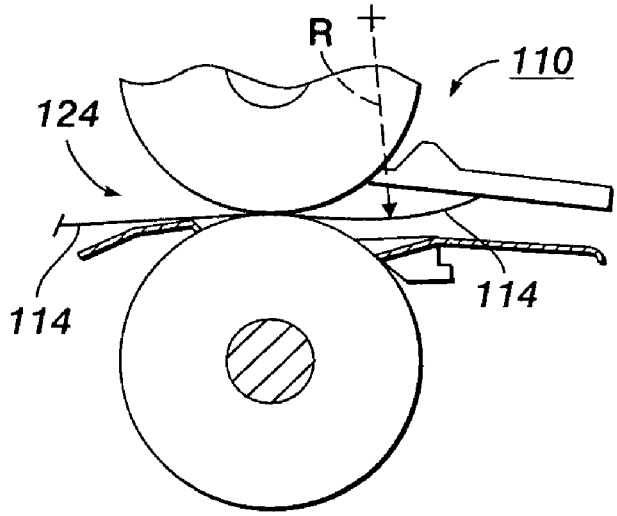
FIGS. 1A and 1B are illustrative examples of a fusing nip cross-section and further illustrate aspects of substrate inversion in accordance with a measurement technique disclosed herein.

The systems and methods disclosed herein will be described in connection with a preferred embodiment, however, it will be understood that there is no intent to limit the teachings to the embodiment described. On the contrary, the intent is to cover all alternatives, modifications, and equivalents as may be included within the spirit and scope of the appended claims. For a general understanding of the present disclosure, reference is made to the drawings. In the drawings, which are not to scale, like reference numerals have been used throughout to designate identical elements.

Many measurement and analysis techniques can be performed on data derived from a recorded image sequence, including recording the operation of a non-contacting fuser with various substrate materials under various conditions. One such measurement is a characterization of lead edge height at a known location. This measurement involves scaling a known geometry ratio to the recorded images, setting up a scale, and measuring the lead edge's height from the normal at a given constant location.

Figure 1B:
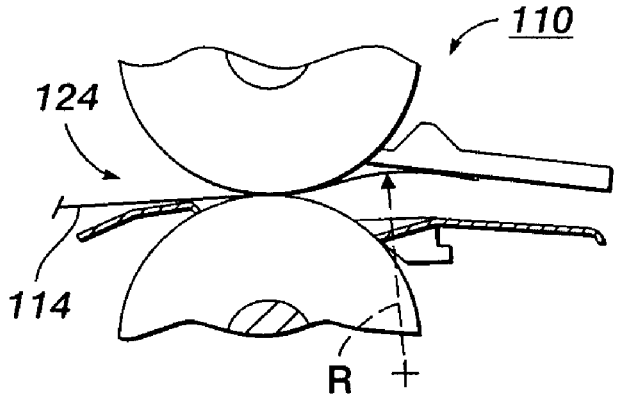
Figure 2:
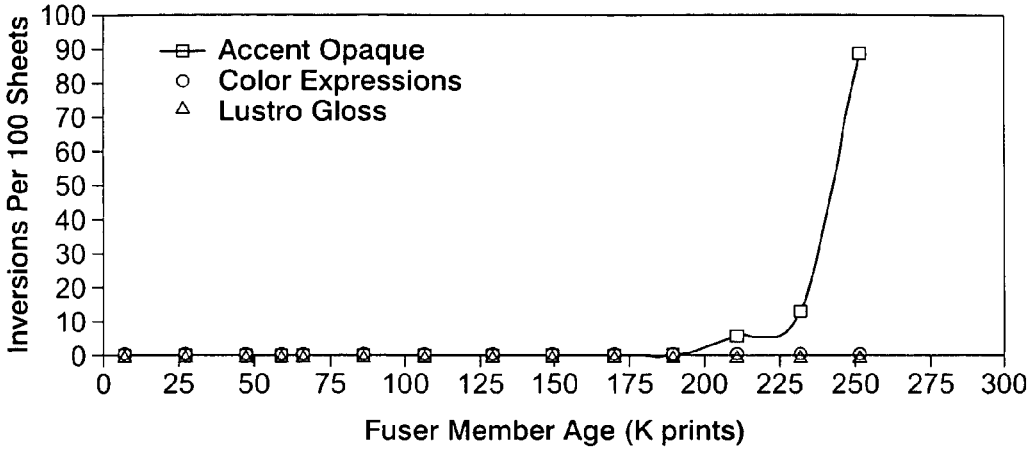
FIG. 2 is an illustrative example of data showing inversion rates (FIGS. 1A-1B) for various substrate types.

A second characteristic or measurement involves calculating the inversion rate of substrates. This technique involves monitoring, on a sheet-by-sheet basis over a predefined interval, and counting the number of inversions that occur during that interval, where an inversion is defined as a sheet whose center of curvature (R) goes from above to below the centerline of the sheet, shown in FIGS. 1A and 1B, and has been determined to be indicative of a hard-stripping sheet. Referring to FIGS. 1A and 1B there are depicted two time sequenced illustrations of a fusing subsystem 110. Upon initially exiting the fuser nip 124 (FIG. 1A), the center of the radius of curvature of the substrate 112 is above the sheet centerline (concave shape), but as the sheet continues it may take on a convex curvature, where the center of the radius of curvature R is below the centerline (FIG. 1B). This inversion rate increases as stripping performance decreases and the sheet leaves the fusing nip at increased angles, as represented by the results reflected in the chart of FIG. 2.

Figure 3A:
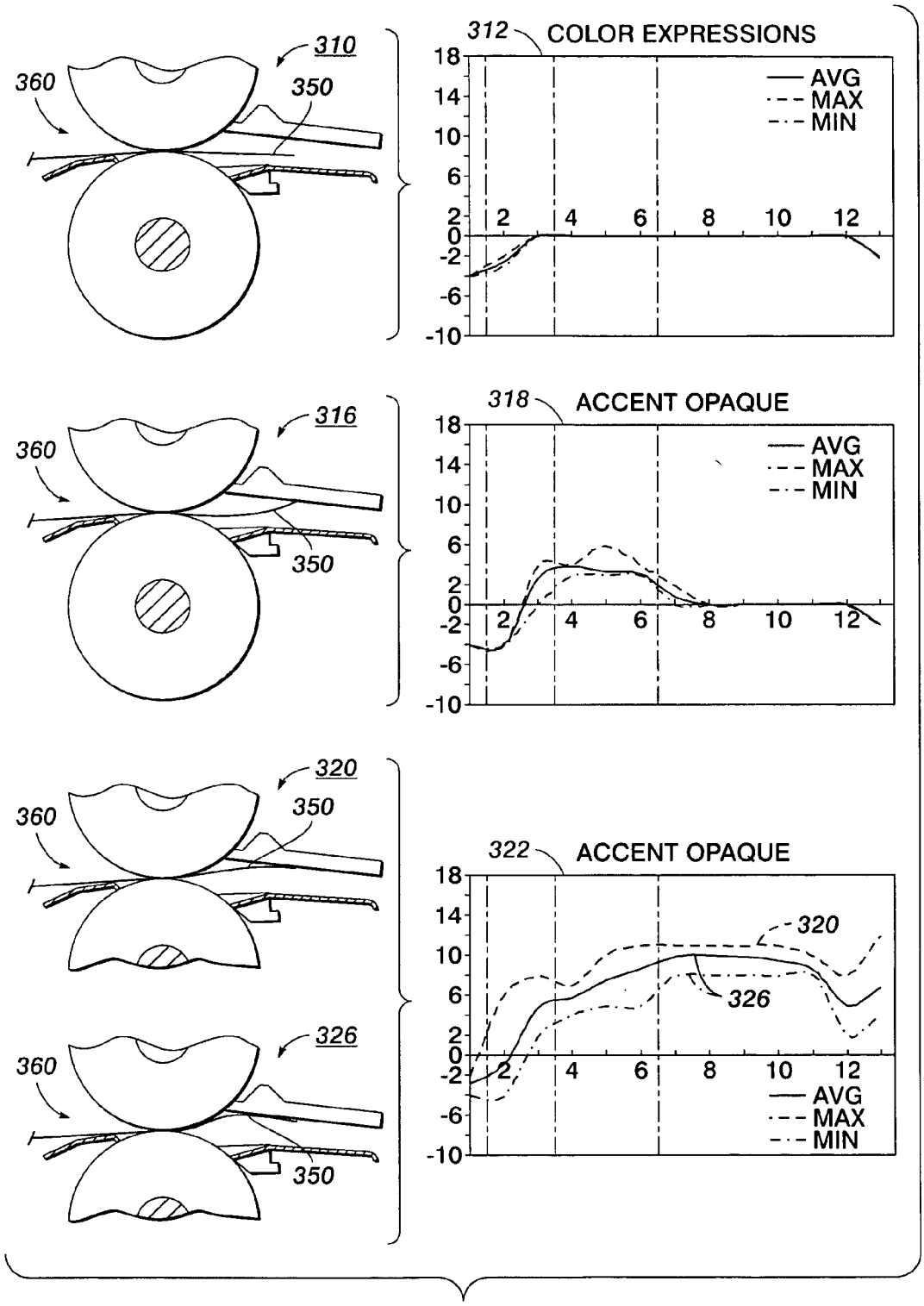
FIGS. 3A-3C are composite illustrations of various trajectories of a substrate sheet exiting a fuser nip as depicted at multiple points or times after exit.
Figure 3B:
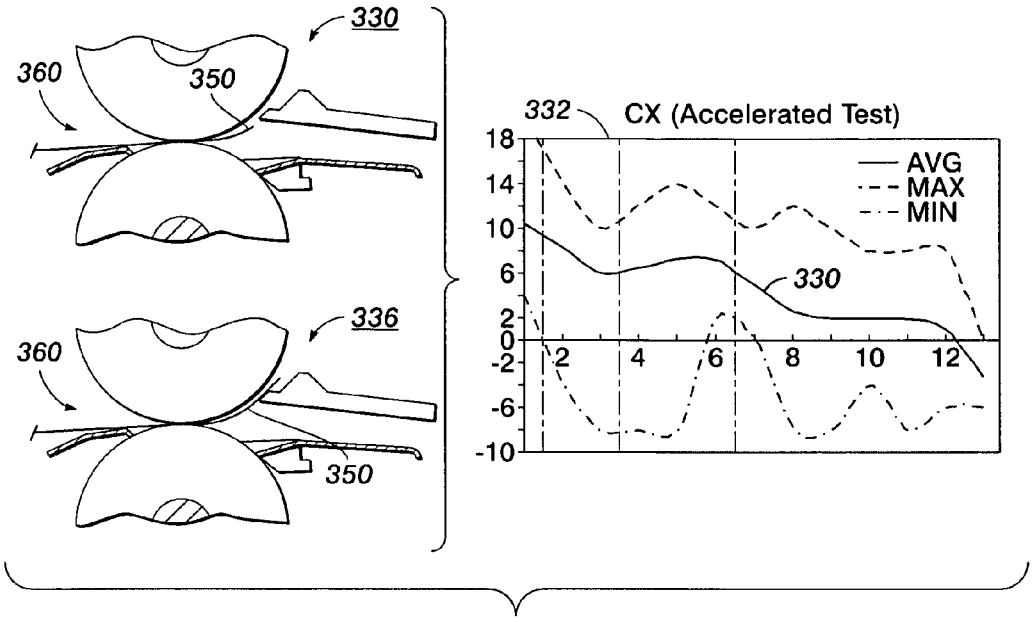

It is also possible to measure the paper edge height at multiple points along the length of the sheet. Although similar to the technique described above, instead of just tracking the lead edge of the sheet at one location, the sheet edge height is measured at multiple points along the sheet at the same location. This edge trace forms distinctive curves, which can be correlated to stripping phenomenon such as ideal stripping, inversion, retack, and normal stripping. Examples of such results are also depicted, for example, in the composite illustrations of FIGS. 3A-3C. Referring first to FIGS. 3A and 3B there are depicted several different behaviors of a substrate 350 passing through the nip 360. In box 310, an ideal release behavior is depicted, where the substrate naturally separates from the fuser roll (top roll) upon departing the nip. Corresponding chart 312 illustrates profiles of the behavior of the end of the substrate sheets as they depart the nip, showing its vertical motion relative to time. Box 316 depicts a normal release for a difficult paper or an aged fuser roll, where the substrate tends upward and is redirected by contact with the air knife housing, stripper finger, baffle, or other structure. The leading edge profile of the release depicted in box 316 is illustrated in corresponding chart 318.

As mentioned above, the possibility of substrate retack occurs, as depicted in box 320, and although there is no visible artifact, the behaviors is nonetheless observable with equipment such as high-speed cameras and the like. Similarly, the retack behavior depicted in box 326 does create a visible artifact and fuser roll contamination. The results of the retack behavior are a significant change in the lead edge behavior of the substrate, and chart 322 illustrates both possibilities. Continuing with the illustrations of FIG. 3B, box 330 illustrates a poor or late release, resulting in possible air knife rib artifacts or fuser roll contamination. The lead edge profile for the substrates exhibiting behavior in box 330 are illustrated in chart 332. Lastly, separation failure, as represented in box 336 results from a failure of the substrate to release from the fuser roll, and the substrate wraps the roll resulting in system shut down and early roll failure due to contamination.

Figure 3C:
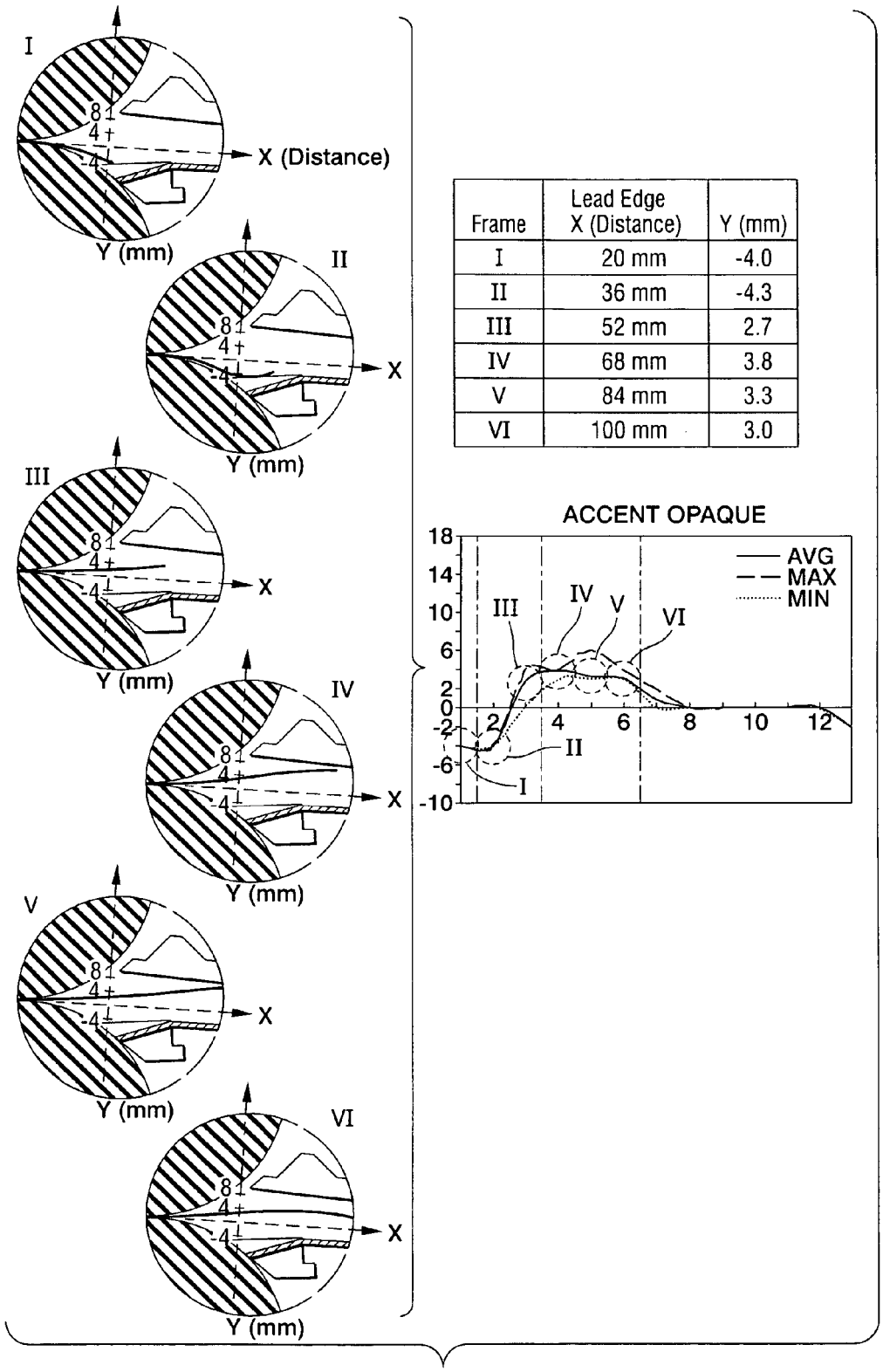

Referring also to FIG. 3*c*, the various illustrations surrounding the central chart are intended to illustrate the manner in which the substrate release signature is observed and measured. In the embodiment depicted the height (Y) of a side of the substrate is monitored over time, as illustrated by the frame numbers as the lead edge continues to move away from the nip. The central chart then depicts the variation in the height of the substrate over time. It is the observation and characterization of the lead edge and substrate height behaviors that permit the use of the various predictive techniques described herein to be employed to monitor and adjust fuser stripping performance.

From such information, the trajectory (height and/or exit angle) of the paper sheet or substrate can be characterized in order to gain information relative to the stripping operation.

Figure 4:
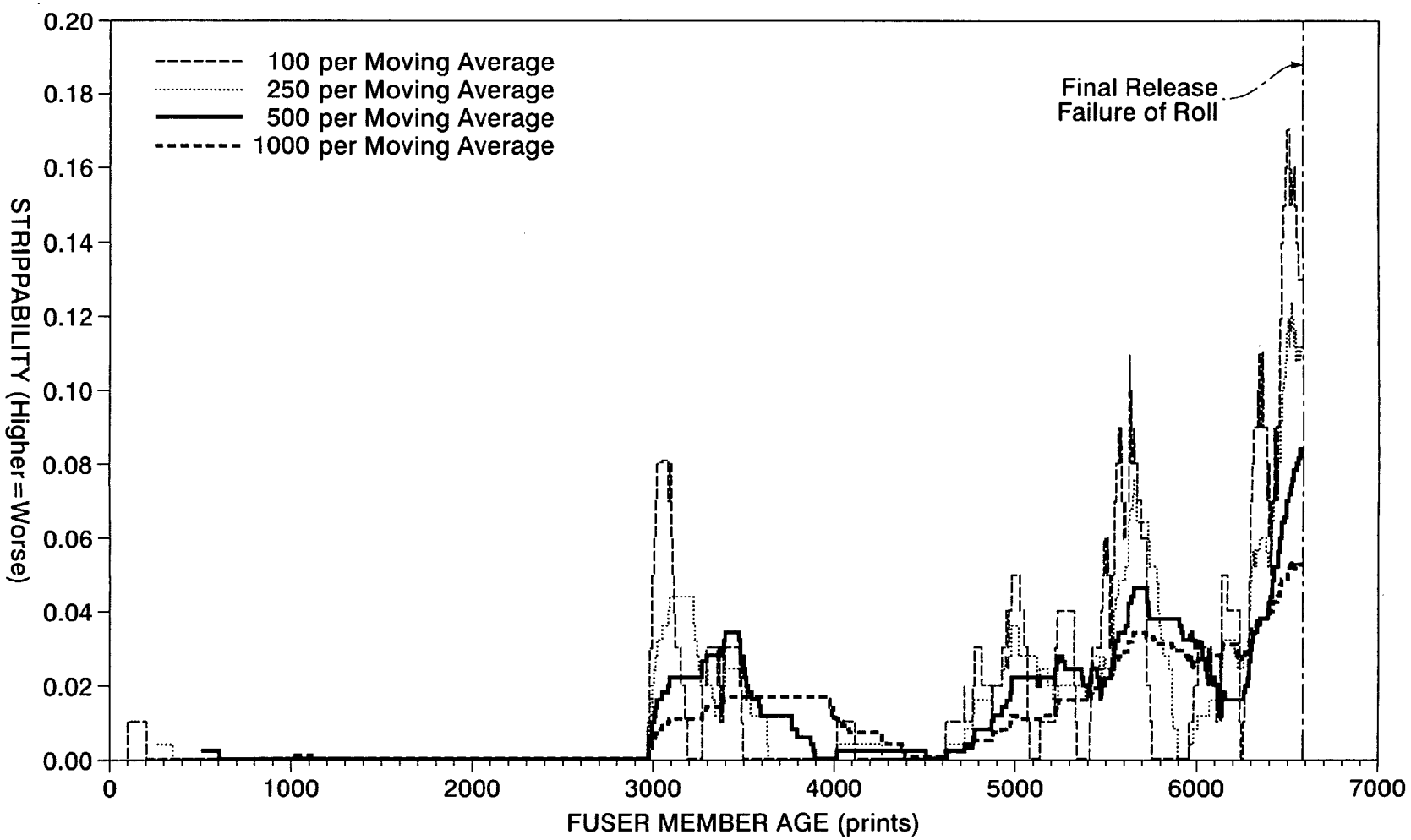
FIG. 4 is a chart depicting data that indicates an increase in jump frequency as a fusing system nears stripping failure in an accelerated life test.

Furthermore, in a manner similar to monitoring the inversion rate, another measurement technique involves calculating the frequency at which a sheet leaves the nip and either comes in contact with or comes close to some upper height threshold (e.g., an air knife). The event is monitored on a sheet by sheet basis and is recorded as either a positive event (sheet hits or is close to air knife) or negative event (does not hit or come close). Taking a moving average of a set range of the previous sheets then monitors the frequency of such occurrences. This technique is the basis for one of the real-time monitoring embodiments described below. An example of the results of such a system are illustrated in FIG. 4, which shows an increase in the "jump" frequency leading up to a fusing failure in an accelerated life test.

Figure 5:
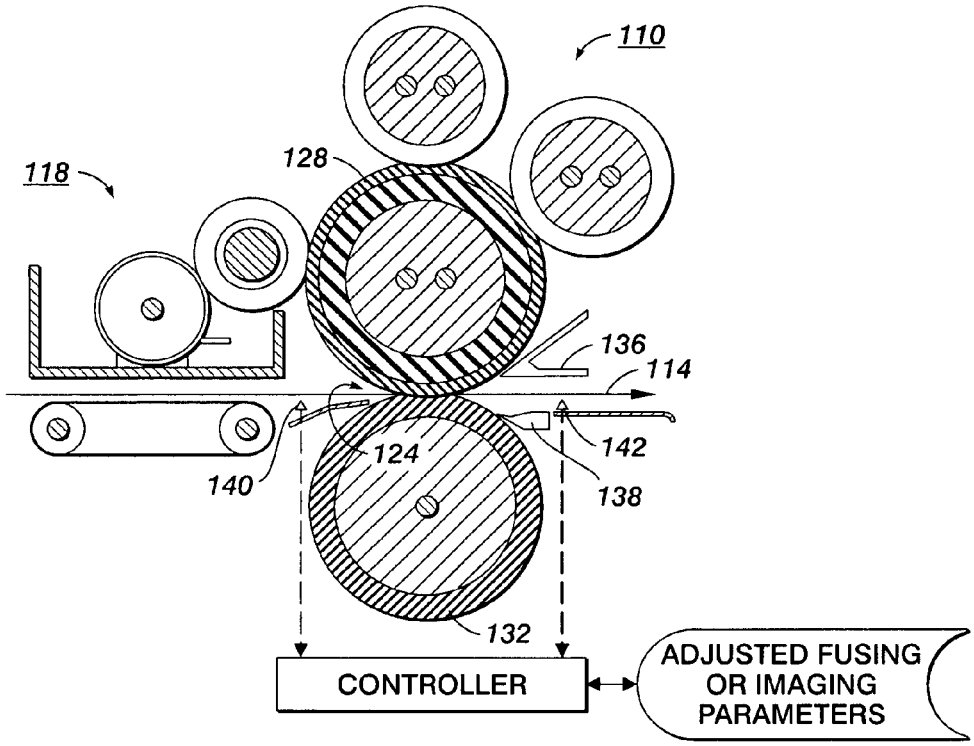
FIG. 5 is a schematic illustration of an exemplary fusing subsystem in accordance with an embodiment disclosed herein.

In another embodiment a timing-based sensing technique is employed to characterize the separation of a substrate from a fuser or similar transport nip. Referring to FIG. 5, there is depicted a fusing subsystem 110. Subsystem 110, operating in a xerographic printing machine, for example, is located in a paper path generally depicted by dashed arrow 114. In such a system, a substrate sheet travels along the path from a prior subsystem (e.g., transfer subsystem 118) and is advanced to nip 124, formed between the fuser roll 128 and a backing or pressure roll 132, one or both of which are driven at a speed regulated by a controller so that the outer surfaces thereof rotate at approximately the same speed as the incoming substrate sheet. Stripping of the substrate from the rolls may be aided by one or more stripping means including an air-knife 136, stripping fingers 138 or the like located in the post-nip region. Typically, the flow of the substrate sheet into and out of the nip is detected by jam detection sensors 140 and 142, respectively.

Employing aspects of the measurement techniques described above, one embodiment depicted in FIG. 5 is directed to a timing-based stripping sensing system, which requires sensors 140 and 142, which may already be in existence in a fusing subsystem. For example, in the Xerox in the iGen™ fusing subsystem, there exist both pre-nip and post-nip jam detectors (e.g., 140, 142), and a fast timing circuit (e.g., a controller) suitable to receive and process information therefrom to provide an indication of the trajectory relative to a nominal level. In one embodiment, the sensors may be optical sensors such as an emitter-detector pair (opposed or using a reflective member), although alternatives such as proximity and mechanical sensors may also be employed in some fusing subsystems.

Figure 6:
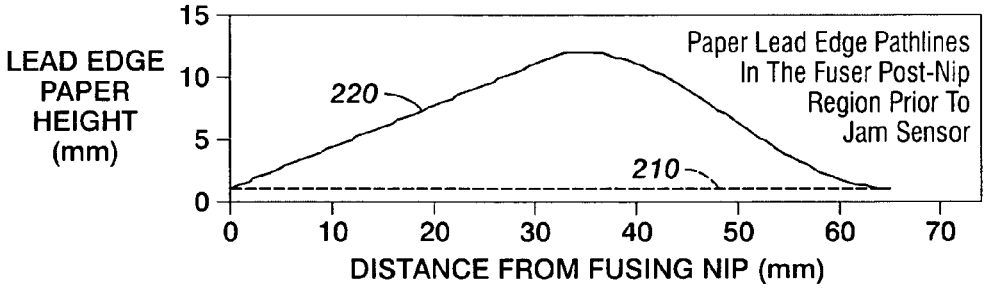
FIG. 6 is a graph depicting pathlines for lead edges of substrates in a post fuser nip region.

In the embodiment of FIG. 5, timing is started when the lead edge of the paper passes the pre-nip sensor 140 and completes when the lead edge trips the post-nip sensor 142. In the configuration depicted, the distance between the two sensors is approximately 130 mm—each sensor being approximately 65 mm from the center of the fuser nip. At a nominal operating speed of 468 mm/s, the activation time between the two sensors should be 277 ms. Referring also to FIG. 6, there is depicted a chart illustrating lead edge paper lines in the post-fuser nip region, where the nominal or ideal path is illustrated as 210 and the poor stripping path is illustrated as 220. If the path length of the paper in the post nip region were to increase by say ten percent over nominal, indicating that the substrate was beginning to warp around a greater portion of the circumference of the fuser roll 128, the activation time between the sensor would increase to 292 ms. By monitoring the activation time and sensing an increase in the paper timing path, 'good' stripping (shorter time close to nominal) can be differentiated from 'poor' stripping (longer time, exceeding nominal), allowing for a prediction of imminent failure and/or compensation as described herein.

The ability to predict a stripping failure, from a change in post-nip timing, also allows the fusing subsystem or other printing machine parameters to be adjusted automatically by a machine or subsystem controller in order to provide active countermeasures to increase or extend fuser roll life. One advantage of the disclosed embodiment is that it does not require additional components as it applies multiple timing sensors already in many fuser subsystems, but uses the timing information in an alternative fashion. Although the stripping performance sensing system itself cannot generate stripping enhancement, it does allow the printing system to anticipate stripping failures or predict shutdowns, and is one means to provide feedback-based control to those devices or subsystems that can alter or enhance stripping performance.

Figure 7:
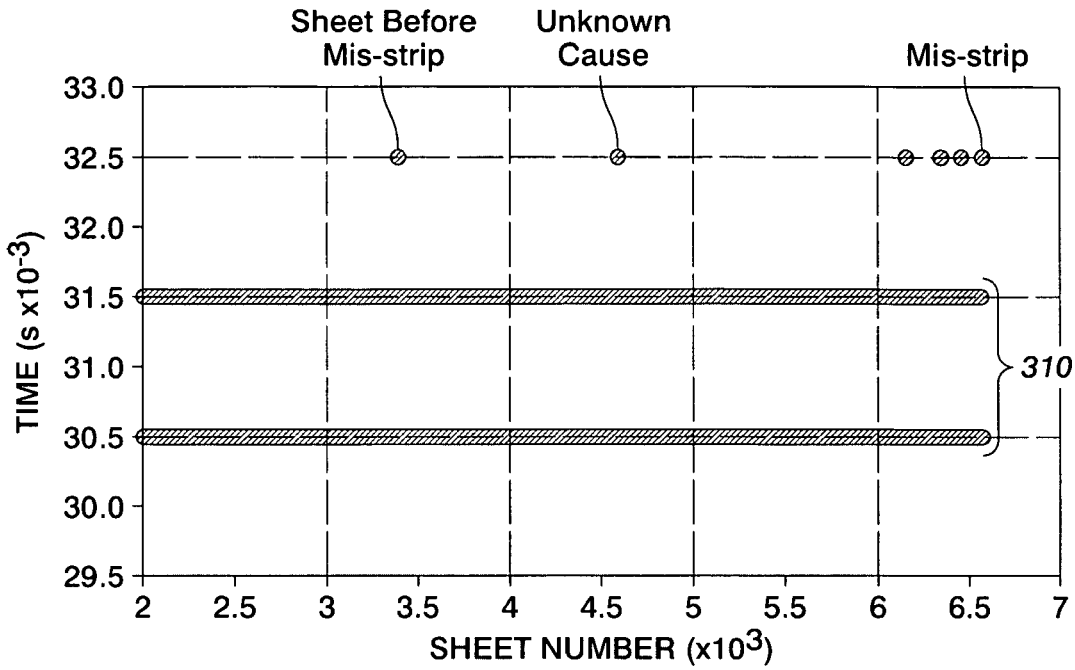
FIG. 7 is an example of test data supporting the use of differential timing sensors for prediction of fuser stripping failure.

To demonstrate the effectiveness of the timing sensor embodiment, a prototype was built using a single pre-nip sensor and several post-nip sensors to perform timing measurements. The post-nip sensors were placed at increasing distances from the nip to record longer times. As described above, the pre-nip sensor triggered the timing sequence for each of the three exit sensors. FIG. 7 shows a sample of the results from one such experiment. The graph shows the timing difference between the furthest upstream and downstream of the plurality of exit sensors for each of several thousand sheets run over the life of a fusing belt. Of the several thousand sheets, six resulted in a differential time that fell outside the 2 ms tolerance band (310) defined by nominally well-stripped sheets. Five of the six sheets were directly correlated with an imminent stripping failure, thereby demonstrating a high degree of correlation between the use of the timing signal and paper mis-stripping.

Calculating paper transit times within a fuser has shown promise in being able to predict stripping failures. Accordingly, the technique is one of several that may be employed, alone or in conjunction with others, to predict and prevent stripping failures.

In an alternative embodiment, the sensing of stripping characteristics to detect or predict stripping failures is accomplished using contact sensors. High-speed video information confirms the post-nip paper behavior of substrates, and has successfully shown that the exiting substrate's height (a signal of paper adhesion to the fuser) correlates with fuser roll release life. Accordingly, in-situ monitoring methods may directly measure paper exit location or timing. FIG. 4 again shows the output of one of these methods during an accelerated life test. The y-axis, a frequency metric of poor sheet stripping, demonstrates a strong predictive signal indicating the fuser's end of life.

As briefly mentioned above, there are several techniques that may be used to compensate for or to handle stressful stripping conditions. Two such examples include increasing the rate at which fuser oil is applied (to promote stripping) and increasing the stripping force. Furthermore, it may be possible to adjust air-knife pressure, or the forces applied by or geometry of other stripping mechanisms (e.g., finger, baffle, air-knife, etc.). Unfortunately, high-speed color fusers, in particular, such solutions may prove difficult to implement or may be less than ideal in their impact. Accordingly, one alternative in such systems may be to simply do nothing, but to warn a user that stripping performance is degraded, especially if the user has chosen a fuser stressing paper/image combination.

The following compensation techniques should also be considered as alternatives for adjusting fusing and/or imaging parameters in the event that the system determines that stripping performance is degrading. FIGS. 8 through 11 illustrate empirical evidence of the efficacy of several of the techniques discussed below. One technique is to adjust the image to reduce stress stripping conditions. Stripping is a strong function of both lead-edge bleed distance and lead-edge toner mass/area (TMA). It may be possible to increase a minimum bleed-edge distance or to use a feathered toner mass/area at the lead edge to avoid stripping failures.

Figure 8:
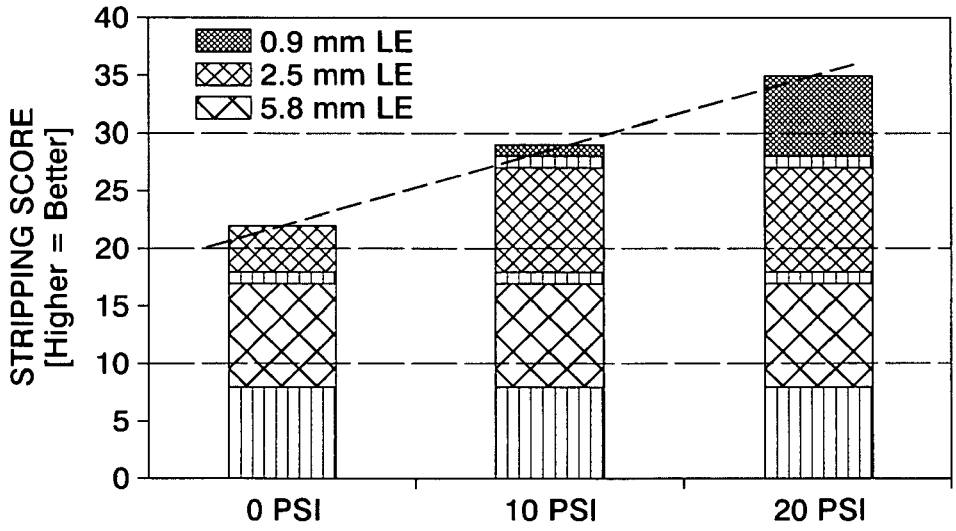
Figure 10:
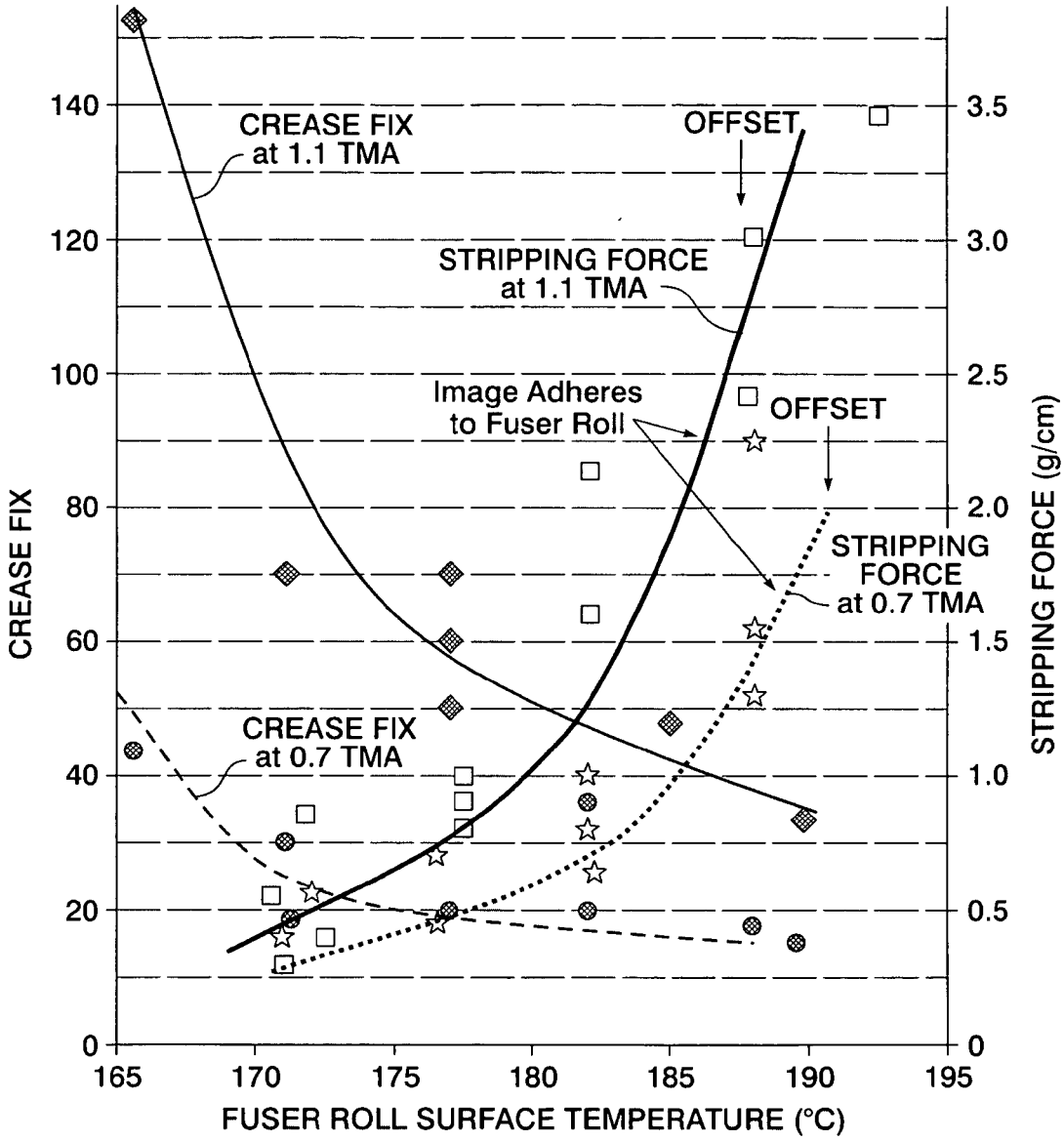

For example, FIG. 8 is a chart illustrating that the stripping performance of a color fuser can be improved (measured by the amount of air pressure required to strip) by increasing the lead-edge bleed distance. FIG. 8 illustrates the effect of lead-edge bleed on stripping. For example, increasing lead-edge bleed to a distance greater than 0.9 mm dramatically reduces required stripping forces in the system studied. Similarly, FIG. 10 shows that reducing image toner mass/area from 1.1 to 0.7 reduces required stripping forces by approximately a factor of two. A similar, although reduced, effect would be seen by feathering to a low toner mass/area at the paper's lead edge.

Figure 9:
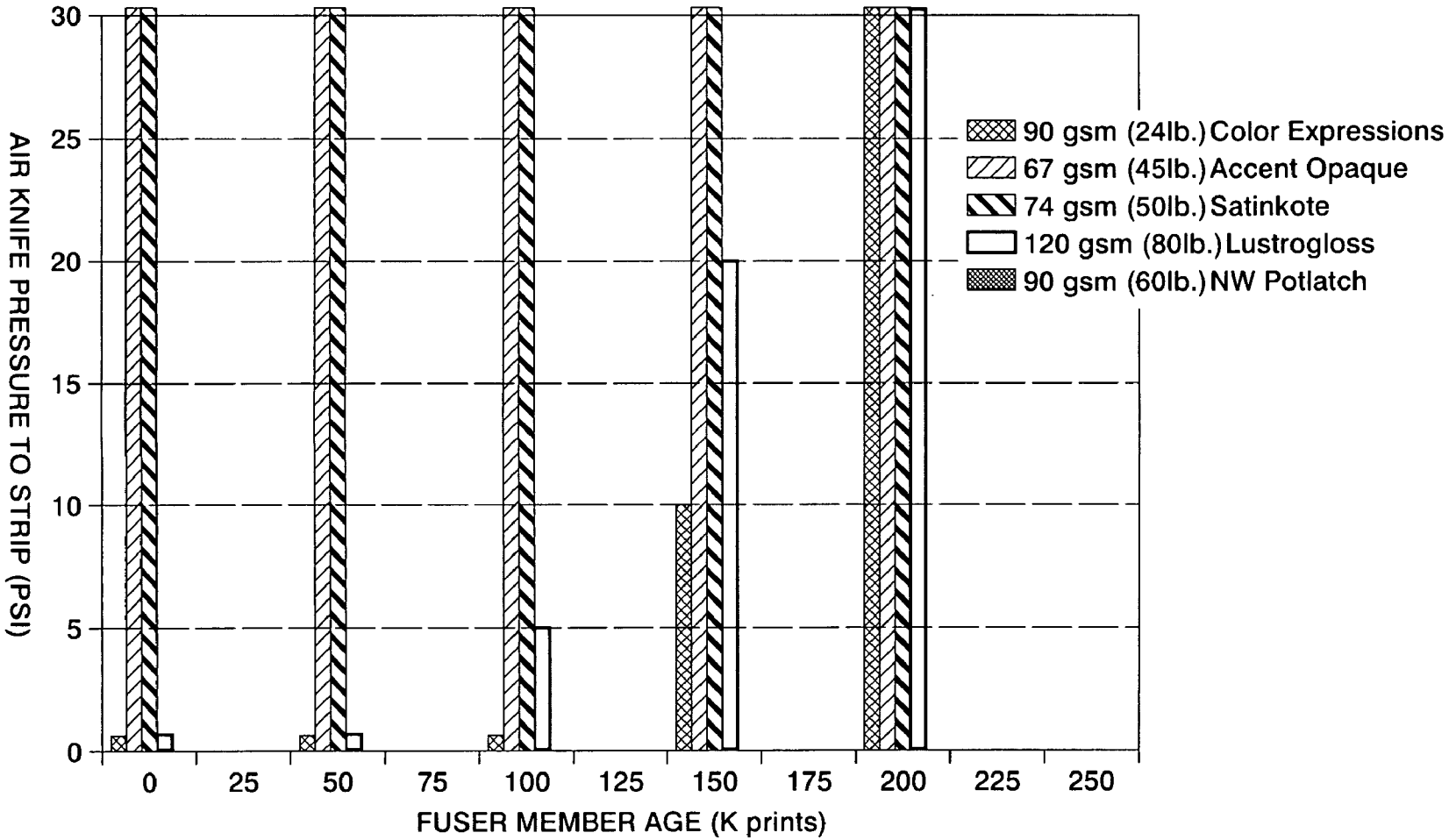

Another alternative compensation technique is to adjust or alter the paper or substrate to reduce stripping stress, including avoidance of "stress papers" (e.g., thinness, coating, and/or grain direction). In other words, substituting a substrate sheet that has different physical properties or characteristics. Although such a technique would not generally be done automatically, the printing system, having being informed of a degraded stripping performance, can warn the customer of expected degraded performance, and suggest alternative papers with better stripping characteristics. As FIG. 9 shows, stripping performance is a strong function of paper choice—where air pressure is an indication of stripping difficulty (i.e., higher pressure indicates worse stripping performance). In the specific case depicted in FIG. 9, a customer could be prompted to avoid the Accent Opaque or Satinkote papers if they were chosen during a time of degraded fuser stripping performance.

Yet another compensation alternative is to alter the fusing temperature to reduce stripping forces. Stripping forces are a strong function of fusing temperature (along with fusing pressure and nip width, as indicated below). For example, FIG. 10 shows the stripping force required to strip toned sheets from a conventional fuser roll—note that increasing the fusing temperature 20° C. increases the required stripping force by a factor of six. In some black/white contact stripping systems, the visible defect attributed to hard stripping (stripper finger marks) can decrease with increasing temperature, so the direction in which to move the temperature is not a priori obvious, as it depends on the specific fuser and materials (toners, oils, etc.). Moreover, although altering the fusing temperature will change the fusing performance of the fuser, there is typically a factor of safety for the fusing setpoint temperature (typically 10-20° F.) to account for variability in such systems.

A further means to compensate for degraded stripping performance in the fuser is to adjust the fuser nip to improve stripping characteristics. Stripping in a soft-roll fuser is to a large extent a function of the nip's 'creep' (the amount by which the fuser's release surface is stretched inside the nip), where the relaxing surface releases an amount of energy at the nip exit, some of which acts to separate the non-compressing toner from the compressing elastomer through a shear stress. FIG. 11 shows the dependence of stripping in a soft-member fuser on creep for a variety of different configurations. It is apparent from FIG. 11 that increases in nip width, which act to increase the creep, result in improved stripping. Admittedly, this is somewhat simplistic, as the effect of nip width is also convoluted with fusing temperature. Other fuser adjustments that may be made to alter the stripping characteristics include: a change in oil rate to reduce toner/fuser adhesion; increasing stripping aggressiveness, via an increase in force or alteration of geometry (through loading force in contact strippers or air pressure in non-contact stripping systems); a reduction in temperature to reduce toner/fuser adhesion; an increase in temperature to reduce stripper-finger marks (depends on stripping system); and a change of the nip dynamics to increase self-stripping tendencies.

Yet another technique being considered to compensate for degraded stripping is pressure-roll torque assist, where the pressure roll is altered to adjust the conformance of the roll at the nip. It will be appreciated that such adjustments dramatically affect the creep and creep profile in the nip, which should affect stripping. All of the techniques set forth above could be used, independently or in various combinations with one another, to improve the stripping characteristics of a given fuser in response to the stripping sensing methods of the prior section. In particular, the use of any of the disclosed sensor/compensation techniques can expand the stripping latitude and effective life of a fusing system, especially in the production printing markets, where increased media latitude is an important design consideration.

Having described one method of assessing stripping performance, and a plurality of techniques which may compensate for degraded fuser stripping performance, attention is now turned to another alternative, yet related, method for characterizing stripping performance—stripping force measurement. Measuring forces in contact stripping has been accomplished using a stripper finger fitted with strain gauges to measure the stripping force. However, such techniques have not been employed to characterize the substrate position, in a soft-roll fuser. Furthermore, measuring forces in a non-contact stripping environment is difficult. Thus, it is desirable to track paper exit trajectories, as indicated above, and to even infer stripping forces from those trajectories (i.e., sheets stripping well leave the nip directly, while sheets stripping poorly, and requiring greater stripping force, stay attached to the roll well after the nip.)

To further illustrate this effect, consider a cantilevered stripper finger 910 as depicted in FIG. 12 (a finger touching a fuser roll surface can be treated in the same manner). A strain gage located at $0 \leqq x_1 \leqq x_P$ will give a voltage signal proportional to the surface strain at its location:

$$V_1 = \tilde{K}_1 \varepsilon_1 = \tilde{K}_1 (t/2)\delta_1'' = K_1 \delta_1'' = \frac{K_1 P}{EI}(x_P - x_1) \quad \text{Eq. 1}$$

where E is the material modulus, I the beam moment of inertia, t the beam thickness, $\epsilon$ the surface strain, and $\delta''$ the beam curvature.

Figure 13:
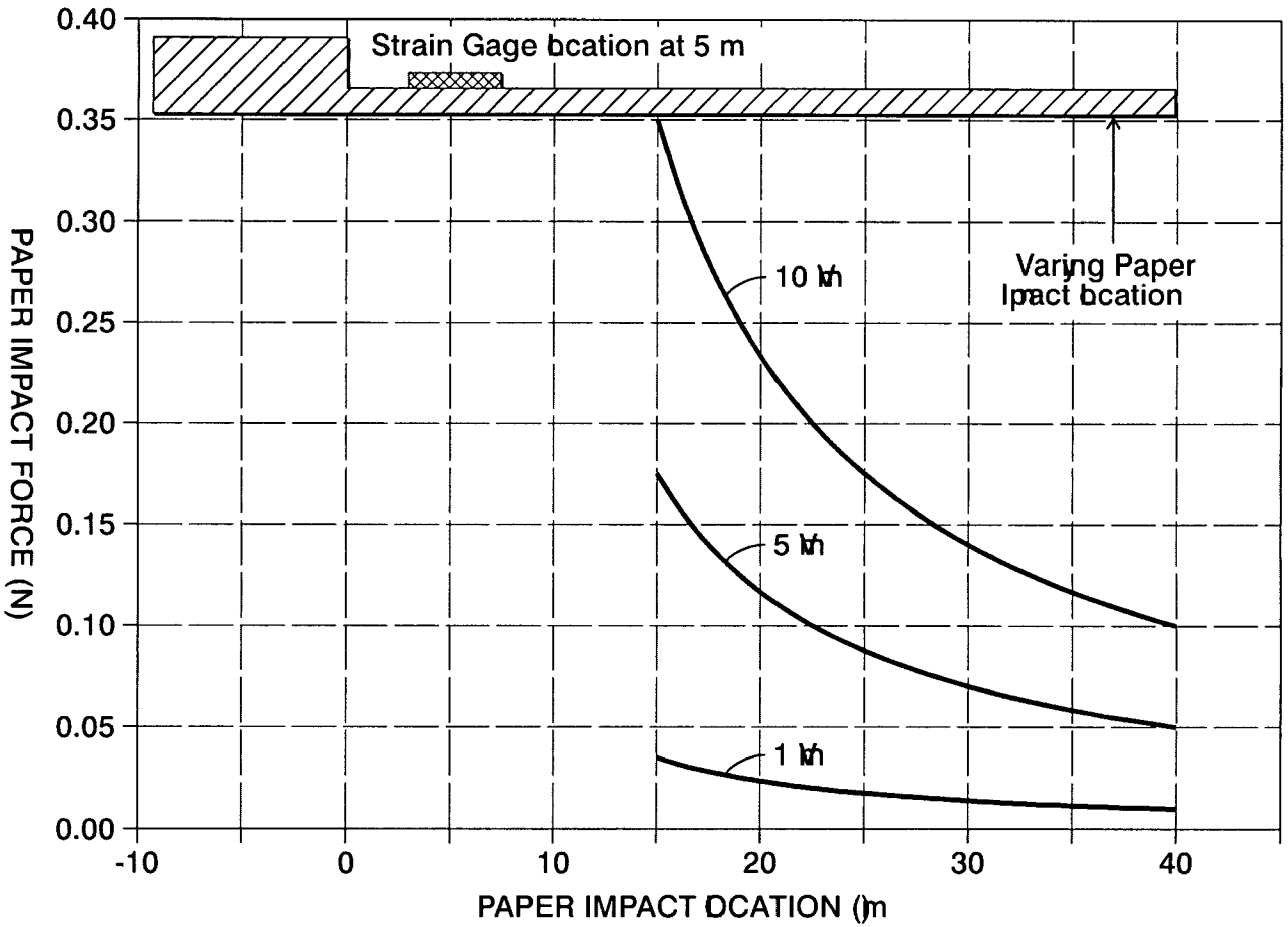
FIG. 13 is a chart illustrating the finger of FIG. 13 and its respective performance characterized using a single strain gauge.

With the two unknowns in Equation 1 being the position the paper hits, $x_P$, and the force with which it hits, P, a single strain gauge can only resolve one unknown. FIG. 13 shows the effect of this variability on a sample configuration. For the idealized case, a measured strain gage voltage of 10 mV can be the result of a 0.17 N impact at 40 mm or a 0.6 N impact at 15 mm. Changes in impact location, therefore, introduce noise in the measured load on the order of the signal to be measured. This limits the utility of stripper fingers with one gauge, as neither of these two important parameters ($x_P$ or P) can be determined explicitly.

However, If two strain gauges are mounted at different x locations, the difference in their signals can be shown to be equivalent to $$V_s \cong -(K_1 x_1 - K_2 x_2)\frac{P}{EI} = \tilde{K}P, \quad \text{Eq. 2}$$

meaning measurement of the differential voltage between the two gauges gives a signal proportional to the applied load, and is independent of the load position.

While useful in some applications, this equation is incapable of resolving the paper impact position, eliminating one major signal relative to stripping performance. Nonetheless, further analysis of the signals from two strain gauges (i.e., not simply subtracting the signals) can resolve uniquely both the load and position of paper impact. In general, consideration of simple beam bending equations and strain gauge behavior indicates that the signals from two strain gauges, located at two different x locations on a cantilevered member, uniquely define a paper impact load and position by:

$$P = \frac{EI}{K_2(x_1 - x_2)}\left(V_2 - \frac{K_2}{K_1}V_1\right) \quad \text{Eqs. 3, 4}$$

$$x_P = x_1 + \frac{x_1 - x_2}{\frac{K_1}{K_2}\frac{V_2}{V_1} - 1}$$

Thus, the use of two gauges provides a direct measurement of stripping force and of paper trajectory exiting the nip, making it useful for both contact and non-contact stripping systems.

Fingers with dual, spaced strain gauges were made and installed into fuser subsystems to allow for testing in both contact and non-contact systems. Moreover, testing has shown the ability of fingers like this one to accurately resolve stripping forces in an operating fuser and to capture the increase in stripping forces indicative of an impending stripping failure.

Figure 14:
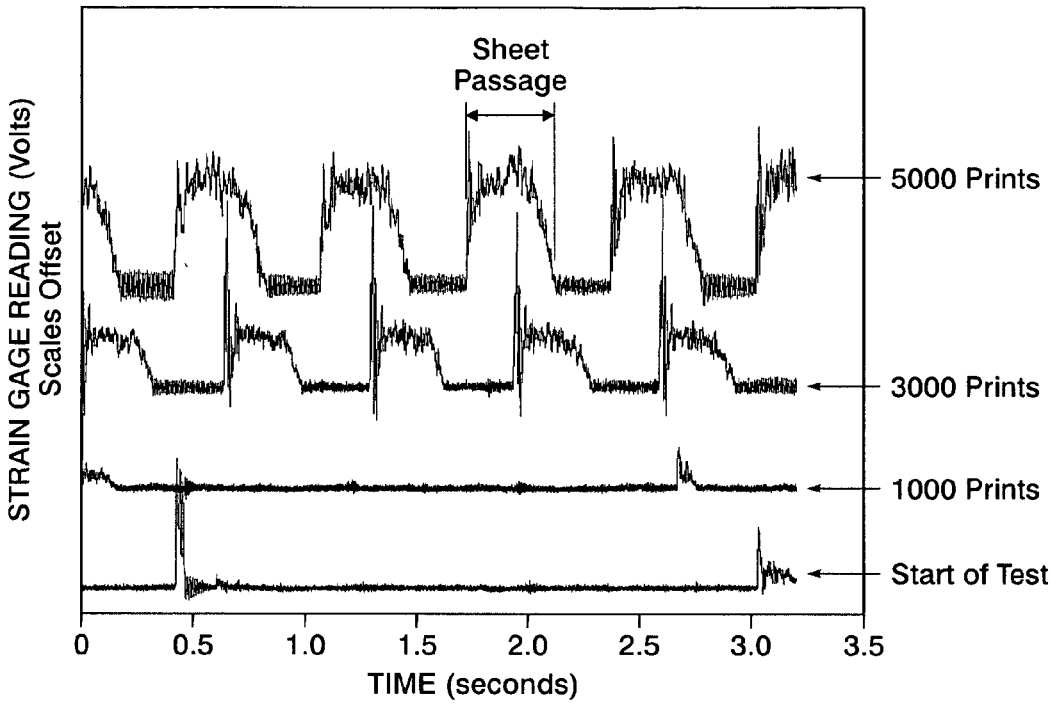
FIG. 14 is an exemplary illustration of test data showing stripping forces with respect to time.
Figure 15:
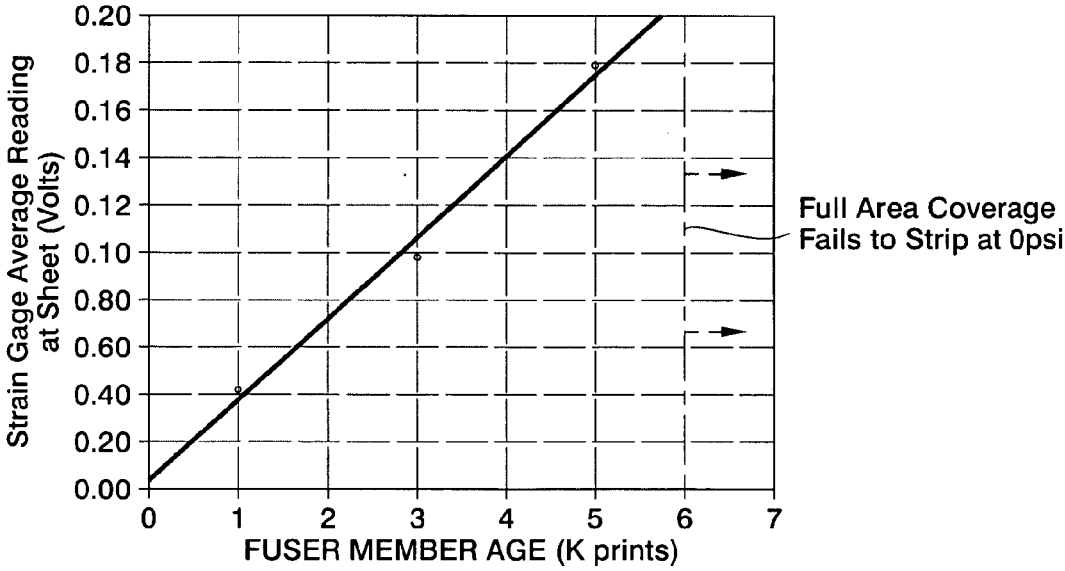
FIG. 15 is a chart depicting the average sheet stripping forces in relation to the number of prints fused.

FIG. 14 shows representative time traces of the stripping force in an accelerated life test, where a fuser nip of 14.55 mm was used to process prints at a speed of approximately 468 mm/sec. The test employed Accent Opaque paper and a full page image with a 1.5 mm bleed area. Note that the stripping force increases dramatically as the roll ages, both for the lead-edge force and the bulk-sheet force. FIG. 15 is a summary plot of the experiment. Note that the average stripping force within a sheet (not the only possible signal) is a predictable indicator of roll life and impending failure.

Figure 16:
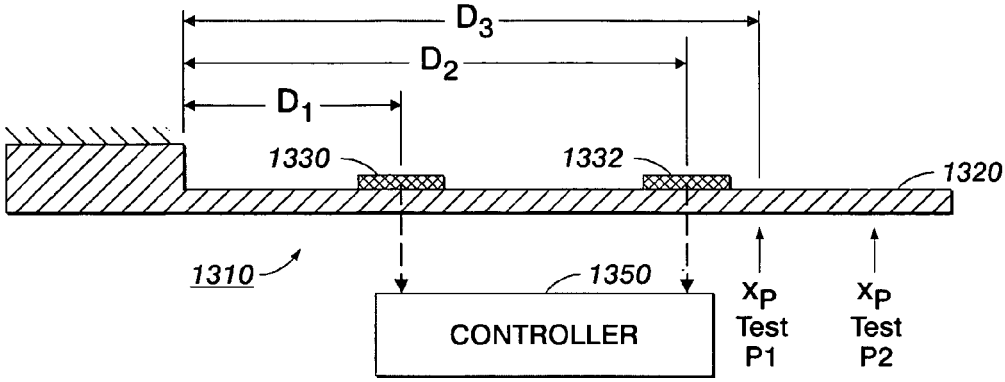
FIG. 16 is a simple schematic illustration of an alternative embodiment of a stripper finger used for sensing a substrate pathline as described herein.

Referring briefly to FIG. 16, there is depicted an example embodiment for the dual strain-gauge finger employed as a sensor. Specifically, finger 1310 has a base for attachment to a structure (not shown), and an extension member 1320. Along extension 1320 are applied a pair of spaced apart strain gauges 1330 and 1332 at distances $D_1$ and $D_2$ from the base. As will be appreciated from the description and equations above, the load applied to the finger extension, as a result of paper contact at about or beyond $D_3$, must be at a position beyond strain gauge 1332 in order to resolve the force and position thereof.

Figure 17:
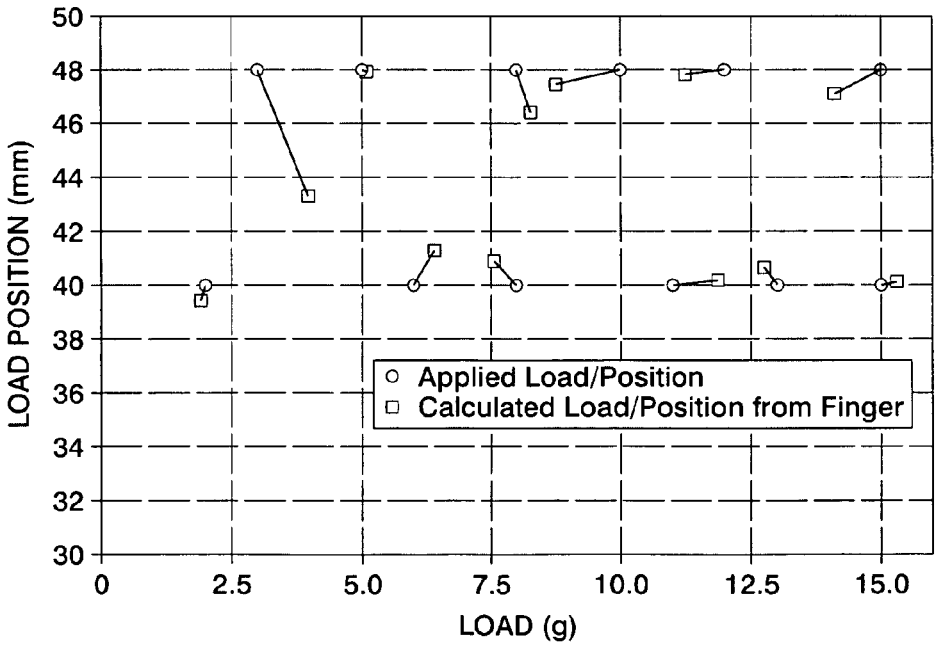
FIG. 17 is a plot demonstrating the accuracy of the embodiment of FIG. 16 in resolving substrate impact force ad location.

The ability of the dual strain gauges depicted in FIG. 16 to resolve both paper force and position was tested. A sample finger was assembled, and forces of varying magnitude and position were applied to it. FIG. 17 shows the results of such a test, where the applied conditions are shown as circles, and the applied conditions back-calculated from the strain gauge signals are shown as squares. With the exception of a single anomaly, the ability of the two gauges to resolve the correct load/position is quite good. All results were accurate to within two millimeters and approximately 1 gram. It will, however, be appreciated that active vibration in an operating fuser may likely increase the noise in the measurements, as will design constraints on the placement of the strain gauges.

Based upon the experiments described above, the use of fingers or baffles with multiple strain gauges at a fuser exit permits the processing of signals from those gauges, at controller 1350, in order to calculate the stripping forces and paper trajectories in an operating fuser. Although not specifically depicted such signals have been shown to correlate with important fusing performance metrics related to stripping (i.e., detecting the position that a substrate strikes a finger may be used to characterize the substrate's pathline. Accordingly, the addition of this type of sensor may permit in-line monitoring of stripping performance and the real-time prediction of fuser roll failure as discussed above. Moreover, this embodiment may be applied to both contact and non-contact stripping systems.

As previously described, optical data may be employed to characterize the typical performance of a fusing subsystem. However, in many cases the measurements described initially relative to several optical techniques, are not easily obtained or processed in an operating system—or may require the addition of costly components. Accordingly, they may be limited to off-line detailed analyses. Nonetheless, there are possibly several real-time measurements that may be employed in order to characterize the performance of the fuser stripping process.

One such measurement is sheet height sensing at a known location downstream of the fusing nip. An alternative, or concurrent, measurement is sensing "jump" frequency with a proximity sensor mounted on or in the air knife. Both measurement techniques involve the addition of a single sensor downstream of the fusing nip. The paper height sensor produces an analog signal for each sheet, thereby providing more information on a per sheet basis than the proximity sensor's binary output. Each measurement scheme outputs a signal that may be processed in real-time to further characterize the probability of a stripping failure.

As with any of the afore-mentioned sensing methods, thresholds or other control parameters (ranges, frequencies, etc.) would need to be defined and tested by a system level or subsystem controller in order to assess the likelihood or probability of a stripping problem and to determine which, if any, countermeasures or compensation techniques are initiated. It should, therefore, be appreciated that one or more processors will operate based upon one or a plurality of inputs as described herein, to detect and monitor fuser stripping performance and to predict degradation so as to control or adjust the fusing and imaging systems of the printer to compensate for such degradation.

The benefit of measuring stripping performance over the life of a fuser roll or fusing subsystem has been described herein. Advances in the sensing of stripping performance in an operational fuser, particularly one employing a non-contact stripping system, identify an increased need for stripping latitude in production systems. As such the systems increasingly require advanced controls and predictive diagnostic techniques for the improvement of system performance, and thereby make it possible to see the advantages of feed-back stripping sensing and control with respect to fuser performance.

The disclosed methods can be used to: decrease the shutdown rate of a given fuser, as the system can sense an impending failure; increase the effective life of a given fuser, as various degraded-performance options or techniques can be used to continue running without increasing the likelihood of a hard stripping failure; and increase the effective stripping performance of a given fuser design, allowing one to trade off for increased speed or life.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method for monitoring stripping performance in a substrate nip, comprising:

detecting, after separation of at least a lead edge of the substrate from rolls forming the substrate nip, at least one characteristic indicative of the separation of a substrate from the nip and generating a signal representing the at least one characteristic, wherein detecting at least one characteristic indicative of the separation of a substrate from the nip, comprises detecting a trajectory of the substrate; and adjusting, in response to the signal, at least one of a plurality of parameters related to the substrate nip to alter the at least one characteristic indicative of the separation of the substrate, and where detecting the trajectory of the substrate comprises indirect measurement thereof by monitoring paper-path timing.

2. A method for monitoring stripping performance in a substrate nip, comprising:

detecting, after separation of at least a lead edge of the substrate from rolls forming the substrate nip, at least one characteristic indicative of the separation of a substrate from the nip and generating a signal representing the at least one characteristic; and adjusting, in response to the signal, at least one of a plurality of parameters related to the substrate nip to alter the at least one characteristic indicative of the separation of the substrate, wherein adjusting at least one of a plurality of parameters related to the substrate nip includes substituting a substrate having different physical characteristics.

3. A method for monitoring stripping performance in a substrate nip, comprising:

detecting, after separation of at least a lead edge of the substrate from rolls forming the substrate nip, at least one characteristic indicative of the separation of a substrate from the nip and generating a signal representing the at least one characteristic; and adjusting, in response to the signal, at least one of a plurality of parameters related to the substrate nip to alter the at least one characteristic indicative of the separation of the substrate, wherein adjusting at least one of a plurality of parameters related to the substrate nip includes adjusting a fuser creep level.

4. The method of claim 3, wherein adjusting the fuser creep level includes adjusting pressure-roll torque assist.

5. A printing system in which a toner image is fused to a substrate sheet in a fuser, comprising: a sensor for monitoring, after separation of at least a lead edge of the substrate sheet from rolls in the fuser, at least one of a plurality of parameters indicating separation of the substrate sheet from the fuser and generating a signal indicative thereof, wherein said fuser is an optical sensor; and a controller, responsive to the signal, for adjusting a fuser creep level, thereby effecting separation of the sheet from the fuser.

* * * * *